United States Patent [19]

Rees

[11] 4,325,303

[45] Apr. 20, 1982

[54] PRINTING MACHINE INK DOCTOR BLADE ADJUSTMENT APPARATUS

[75] Inventor: Werner Rees, Augsburg, Fed. Rep. of Germany

[73] Assignee: M.A.N.-Roland Druckmaschinen Aktiengesellschaft, Offenbach am Main, Fed. Rep. of Germany

[21] Appl. No.: 185,414

[22] Filed: Sep. 9, 1980

[30] Foreign Application Priority Data

Sep. 22, 1979 [DE] Fed. Rep. of Germany ..... 2938487

[51] Int. Cl.[3] ..... B41F 31/04; B41L 27/06

[52] U.S. Cl. ..... 101/365; 118/261

[58] Field of Search ..... 101/365, 350, 363, 207, 101/208, 210; 118/261

[56] References Cited

U.S. PATENT DOCUMENTS

| | | | |
|---|---|---|---|
| 3,057,294 | 10/1962 | Jameson | 101/365 |
| 3,792,659 | 2/1974 | Albrecht | 101/365 |
| 3,921,525 | 11/1975 | D'Amato et al. | 101/365 |
| 4,213,390 | 7/1980 | Liebert et al. | 101/365 |

FOREIGN PATENT DOCUMENTS

| | | | |
|---|---|---|---|
| 7730668 | 1/1978 | Fed. Rep. of Germany . | |
| 2756510 | 6/1978 | Fed. Rep. of Germany | 101/365 |

*Primary Examiner*—J. Reed Fisher

*Attorney, Agent, or Firm*—Frishauf, Holtz, Goodman & Woodward

[57] ABSTRACT

To permit safe removal of a carrier plate supporting a plurality of doctor blade adjustment motors and gearing elements therefor, and additionally, at the outside of the plate, position indicating and transducer elements, at least one, and preferably two or more support rails are secured to the doctor blade holding frame, extending from the frame in a direction beyond the side of the carrier plate and remote from the side facing the doctor blade, on which the motor and gearing is secured. The plate is formed with openings, forming suspensions (26) slidable on the rails (23) for lateral removal of the plate, together with all equipment carried thereon, and disengagement of electrical contacts (8) from matching contact rails or buses carried in the frame. After such lateral removal to an end stop (29), pivot pins (36) can be engaged in matching openings (32, 33) formed in projecting end portions (31) on the frame and in the plate, respectively, so that, after removal of the stop (29), the plate and all elements thereon can be tilted or tipped for servicing of apparatus or equipment carried thereon. No lifting or complete removal of the plate from the apparatus is necessary, thus permitting one-man servicing operation and insuring safety of the operator by continued support of the heavy plate and the equipment thereon, from the printing machine to which the doctor blade adjustment apparatus is attached.

9 Claims, 3 Drawing Figures

PRINTING MACHINE INK DOCTOR BLADE ADJUSTMENT APPARATUS

REFERENCE TO RELATED APPLICATION

U.S. Ser. No. 185,390, filed Sept. 9, 1980, by the inventor hereof, assigned to the assignee of this application.

The present invention relates to printing machines, and more particularly to an adjustment arrangement for doctor blades for use in the inking system of a printing machine, and especially to the holding apparatus for the doctor blade.

BACKGROUND AND PRIOR ART

Printing machines using doctor blades in the inking systems usually have a plurality of adjustment pins or bolts which are coupled to the doctor blade so that the adjustment pressure of various regions of the doctor blade—which extends over the width of the inking cylinder—can be properly controlled. Some such apparatus use positioning motors to permit remote control of the individual adjustment pins or bolts of the doctor blade. The motors and the associated drive gears require service and maintenance from time to time.

It has been proposed to secure the motors on a cover of a housing or frame—see German Utility Model DE-GM No. 77 30 668. The motors and the associated apparatus becomes accessible for maintenance after removal of the cover plate. Thus, service of the motors and/or associated gearing and positioning apparatus can be effected easily after removal of the cover plate. Difficulties arise if additional structural elements are to be associated with the motors and/or the doctor blade positioning pins, respectively. Such additional apparatus may, for example, be remote indicating devices to indicate the particular position of the doctor blade, sensors or transducers for self-adjusting servo motors to provide positioning feedback and the like. The space available on the holding plate then becomes insufficient. Lateral extension of the holding plate or of chambers within the holding plate where the motors are located is not a proper solution since, then the distance between doctor blade adjustment pins must be increased beyond a proper limit. Accurate adjustment of the doctor blade with all circumferential areas of the associated printing cylinder may become impaired. The holding plate itself cannot be increased since, then, the overall printing machine must be built to be larger.

It has been proposed to utilize both sides of the holder plates to place constructional elements thereon. Access to the elements located at the inner portion of the housing, then, requires however that the elements at the outer side of the housing also be removed or specially protected. The holder plates, consisting of heavy pieces of metal, are heavy and of substantial size—extending across the width of the machine—and removal of the holder plate to obtain access to the interior of the inking mechanism for service of motors, gearing, or the like, introduces a hazard; after removal of holding bolts for the plates, the heavy plate may drop, causing damage to elements secured thereto and, additionally, resulting in a condition hazardous to personnel.

THE INVENTION

It is an object to provide an arrangement to permit placement elements in addition to a positioning motor on a holder plate which is so made that access to the various constructional elements at both sides of a closing or holder plate can be insured without damage to the elements, and without introducing hazardous working conditions.

Briefly, the frame or support member for the inking device has at least one, and preferably two support rails secured thereto, extending in a direction beyond the side of the carrier plate and remote from the side of the carrier plate facing the doctor blade. The carrier plate includes suspension means, for example openings formed therein which can slide on the rails to suspend the carrier plate thereon so that the plate can be slid outwardly away from engagement with the frame supporting the doctor blade adjustment mechanism. This provides access to the interior of the frame element, and to such structural elements—for example positioning motors, gearing, and the like, which are secured to the plate, as well as to such other elements which may be secured thereto, for example a positioning device. The frame of the inking system additionally is formed with lateral wings which can engage in pivots formed on the plate, for example by insertion of separable pins, so that the plate, after lateral withdrawal on the rails to a stop thereon, can be pivoted for free access to components thereon after removal of the stop from the rails.

The structure has the advantage that the heavy plate, and such components as may be mounted thereon, near has to be lifted physically away from the apparatus, since it always remains connected thereto—either by being suspended on the rails or by being held in position by the pivots. Suspension from the rails permits accurate positioning of the plate so that electrical contacts provided thereon can engage in sliding, wiping contact arrangement with fixed contacts located within the inking system. Servicing, thus, is facilitated since a single mechanic can operate and handle the arrangement since the removal of the plate from the apparatus itself is no longer necessary but simple sliding and pivoting movement suffices, which is readily within the strength capability of servicing personnel. Hazards, due to the falling heavy metal objects, likewise are eliminated. A previously somewhat hazardous operation requiring two men now can be carried out by one operator with safety.

DRAWINGS

Figure 1:
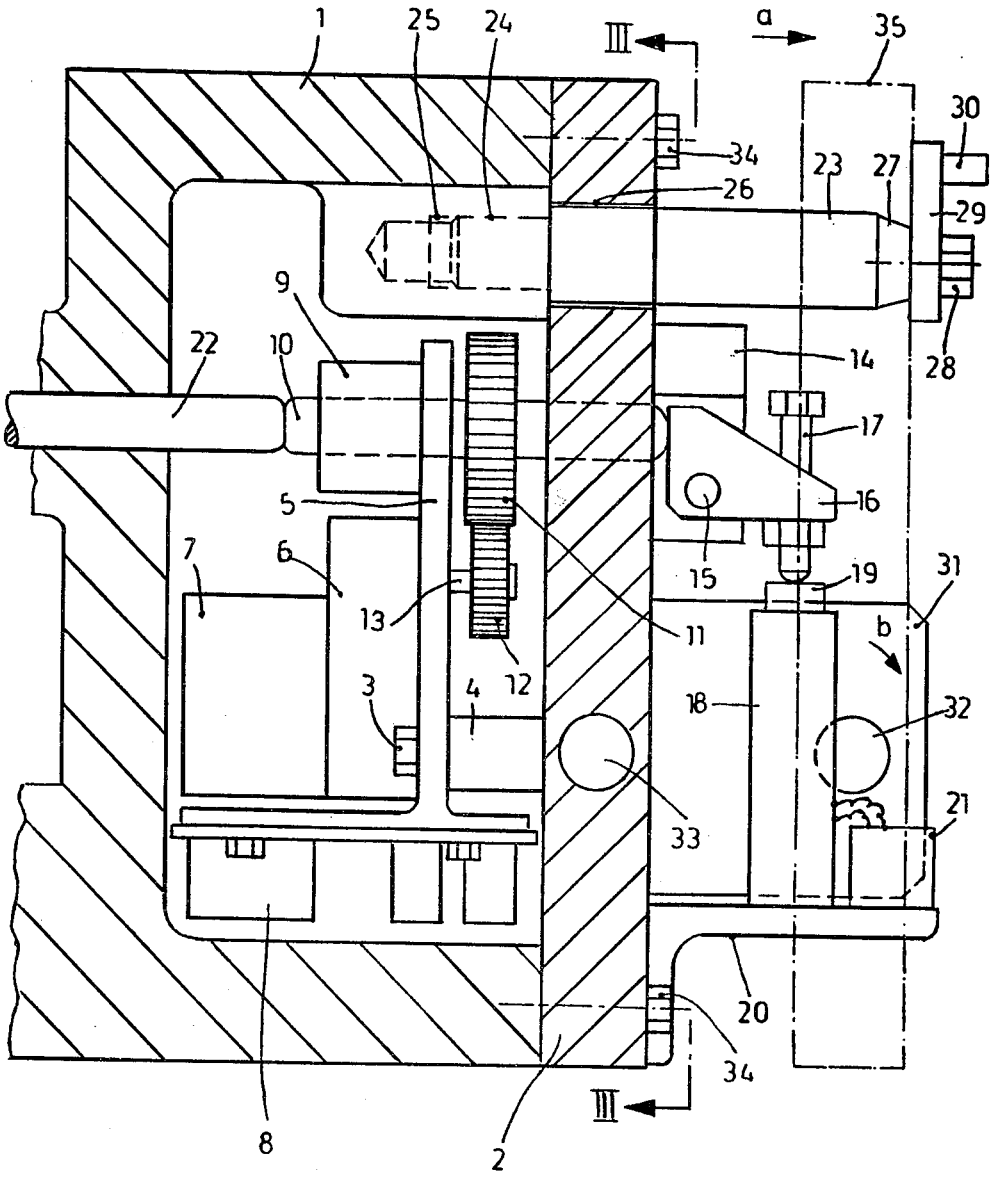
FIG. 1 is a schematic cross-sectional view through an inking system doctor blade adjustment apparatus.

A frame 1 forms a housing for the doctor blade adjustment mechanism. The doctor blade, itself, is not shown and would be positioned at the left side (with respect to FIG. 1) of the housing. The housing, generally, is a U-shaped element closed off at the back by a carrier plate 2. The side of the carrier plate 2 facing the interior of the housing supports a holder bracket 5, attached to the carrier plate by screws 3 and spacers 4. The bracket 5 supports an electric motor 7, rotatably coupled to a reduction gearing 6. The electric motor 7 is supplied with current by connecting terminals 8 which can form wiping connections with suitably positioned connecting channels, not shown, and positioned, for example, in electrical connecting troughs within the frame 1. The bracket 5 additionally supports a bushing 9 having an internal thread. An external thread of a pin 10 is engaged in the internal thread of the bushing 9. The pin 10 has a gear 11 secured thereto which meshes with a pinion 12 attached to the output shaft 13 of gear 6.

The external side of the plate 2, that is, the side facing away from the doctor blade, has a projection 14 attached thereto which carries a shaft 15. Shaft 15 supports a double-armed lever element 16 which engages at the left side with pin 10 and at the right side, that is, the horizontal part of the lever, with a motion transfer adjustment screw 17. The adjustment screw 17 bears against the end portion 19 of a position transducer 18, portion 19 being maintained in contact with the screw 17 by a spring (not shown). The unit 18 is supported on the outer side of plate 2 by an angled bracket 20 which, additionally, carries a channel or duct or trough 21 for electrical wiring connected to the transducer 18. The elements 10, 16, 17, 19 form a position sensing unit, which provides electrical output signals representative of the actual axial position of pin 10, and hence of a doctor blade adjustment pin or bolt 22, and are described in detail in the reference application Ser. No. 185,390, filed Sept. 9, 1980, by the inventor thereof.

The motion transfer pin or bolt 22 directly transfer axial positioning movement of the pin 11 to a doctor blade (not shown). The outer end of pin 11 transfers this movement to the transducer 18.

The holder plate 2 extends preferably over the entire width of the machine, that is, is at least approximately as wide as the doctor blade. In ordinary printing machine, the plate 2 thus will extend between the side walls of the machine. Such an arrangement with the unitary plate 2 has the advantage that all motors and gears secured to the plate can be serviced upon a single removal operation of the plate 2, and any troubleshooting which is required will permit access to all the motors and gears, including associated apparatus, in one single service operation.

In accordance with the invention, and to permit safe and troublefree removal of the plate 2 and all the elements carried thereon, support rails 23 are secured to the frame 1 adjacent the side walls of the machine. Each one of the rails 23 which, preferably, are in the form of circular bolts or cylindrical elements, is securely attached to the frame 1, for example by screwing a tapped end portion 24 into a thread 25 formed in the frame 1. Each one of the rails 23 extends laterally outwardly of the plate 2, passing through a matching opening 26 formed in the support plate 2. The opening 26, in case of a cylindrical element, will be round and slightly larger than the outer diameter of the rail 23, so as to provide for some play. The outer end portion of the rail 23 is conically reduced, as seen at 27, to form a tapered end. The free end of the rails 23 have a stop element 29 applied thereto, secured by a nut 28. Preferably, the stop elements 29 each have a handle 30.

Two laterally projecting plates 31 (FIGS. 1, 3) are positioned at the ends of the frame, to form projecting wings. The wings 31 have cross bores 32. The holder plates 2 each have a blind bore 33 at their ends, having a diameter equal to the diameter of the cross bore 32. Screws 34 (FIGS. 1, 3) secure the carrier plate 2 in position on the frame 1 when the machine is in operating mode.

Servicing and removal of carrier plate: In operating position, the holder plate 2 is secured to the frame 1 by the screws 34, as shown in the full-line position in FIG. 1. If it is necessary to service the motor 7 and/or the gears 6, to replace any one of the elements, to provide lubricant or the like, screws 34 are first removed. The holder plate 2 will drop slightly, and hang on the carrier rails 23. It is not necessary to support the plate 2 by operating personnel; the rails 23 are dimensioned to be sufficiently strong to be able to carry and individually support plate 2 and all the elements secured thereto, when freely suspended from the rails 23. Thus, after releasing the screws 34, a single mechanic can carry out servicing of apparatus secured to the plate 2, without requiring additional personnel or helpers to hold the rather heavy plate 2, or to assist in the removal operation.

Figure 2:
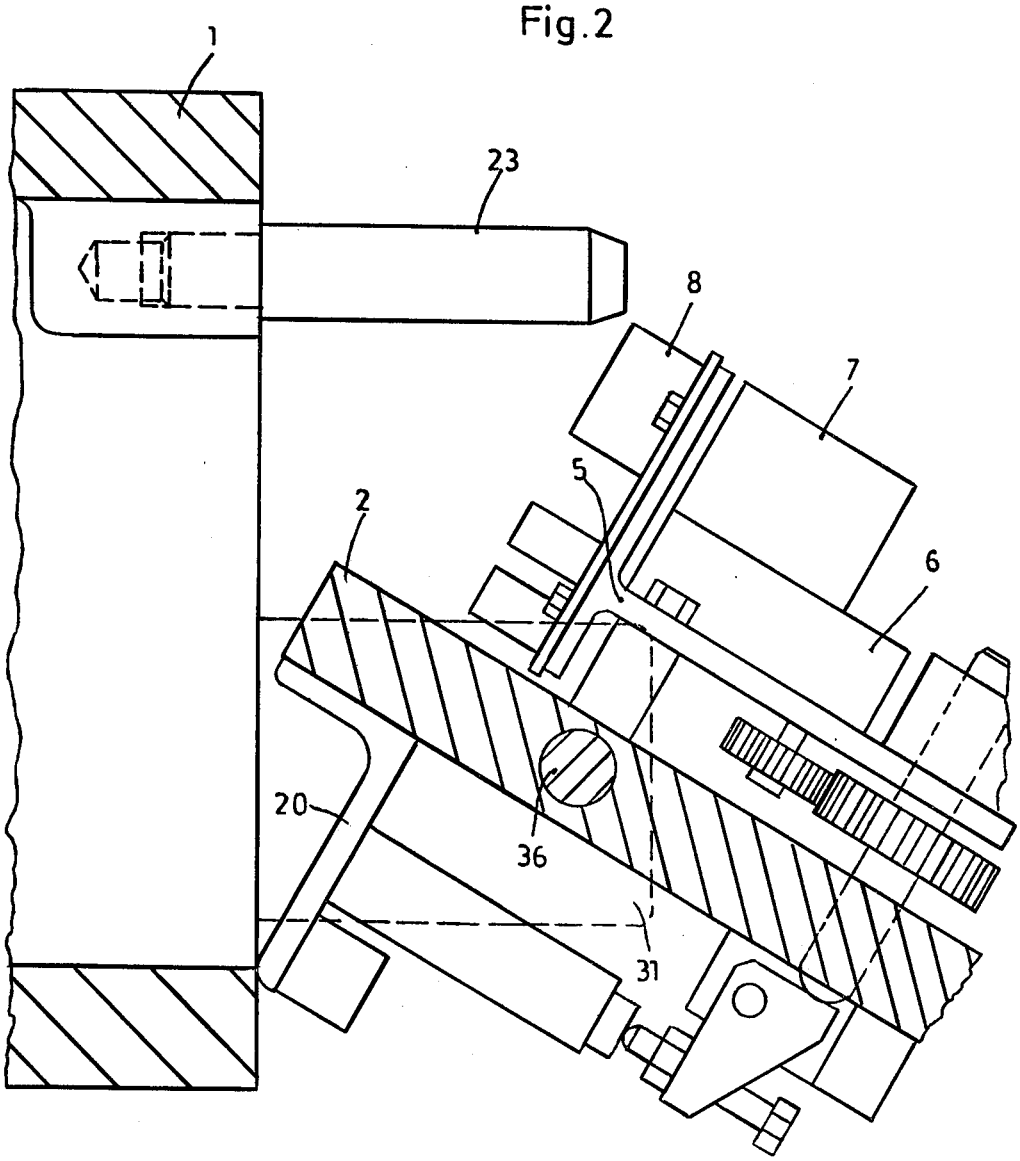
FIG. 2 illustrates the arrangement according to FIG. 1 in servicing position.
Figure 3:
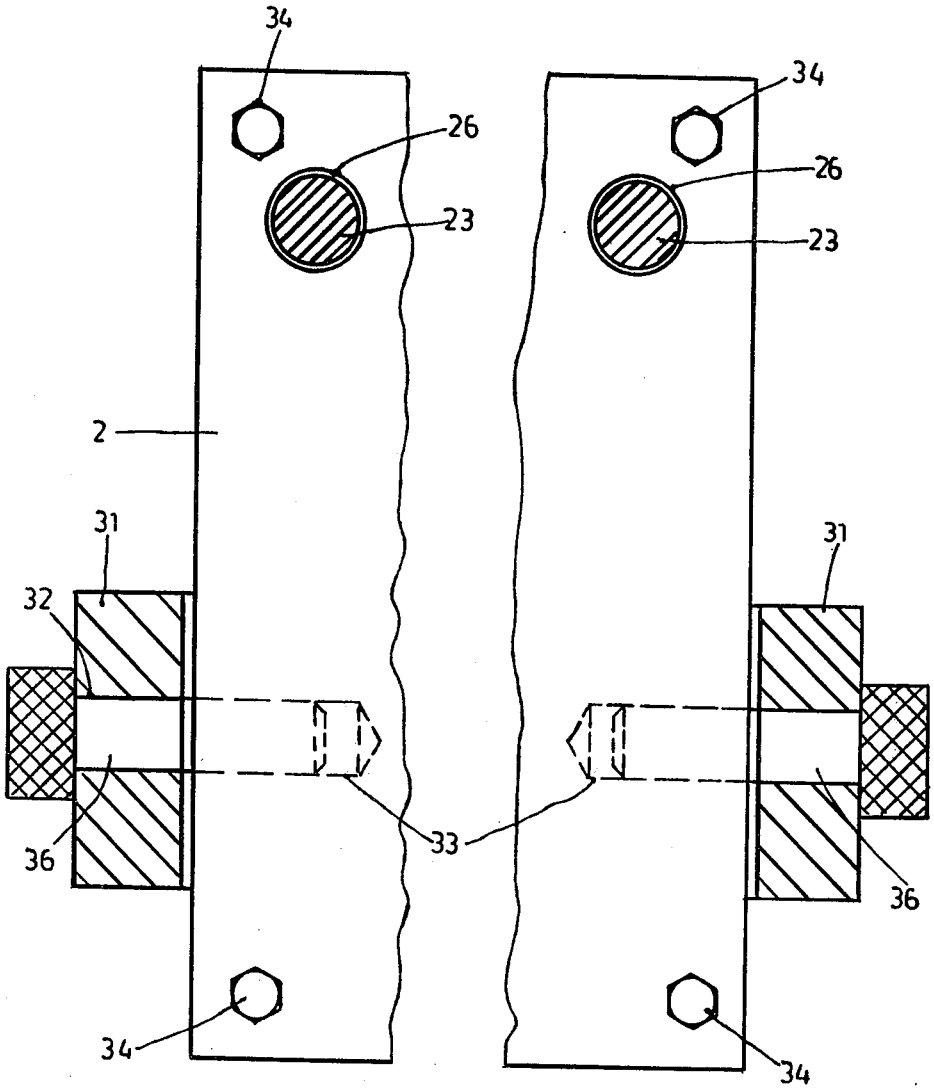
FIG. 3 is a fragmentary sectional view along line III—III of FIG. 1.

Upon loosening and removal of screws 34, the holder plate is pulled out in the direction of the arrow a (FIG. 1) along the support rails 23 until it engages with the stops 29. This intermediate position of the holder plate is shown in chain-dotted lines in FIG. 1. In this intermediate position, the cross bores 32 in the wings 31 match the position of the blind bores 33 in plate 2. Pins 36 are then inserted into each one of the bores, as best seen in FIG. 3. The nuts 28 securing stops 29 in position can now be released, and the stops 29 can be removed. This permits tilting of the plate 2, and all the components contained therein, from the position to the position shown in FIG. 2. The conical, tapered end portion 27 of the carrier rail 26 simplifies and readily permits pivoting movement over the plate 2 and the associated equipment secured thereto over the pivoting axis formed by pin 36. Pivoting movement is in the direction of the arrow b (FIG. 1) until the bracket 20 engages a wall of the frame 1, as seen in FIG. 2. The length of the rails 23, and the position of the bores 32 in the wings 31, is preferably so selected that the tilting angle of the holding plate is between 90° and 180°. This permits tilting of the plate 2 into a suitable service position which provides ready access to the components secured to the plate 2 at its inner side.

After servicing, the holder plate is tilted back into the position shown in chain-dotted lines at 35 in FIG. 1. The stops 29, easily gripped by handles 30, are placed in position, and nuts 28 secured thereover. The carrier plate 2 is then slid towards the left, counter the direction of arrow a in the operating position shown in full lines in FIG. 1, and secured in final position by screws 34. Contact blades 8, upon such movement, will make wiping contact with suitably transversely positioned matching contact elements, as is well known in the electrical connection field.

The carrier rails 23 thus provide for parallel, translatory movement of the carrier plate 2. For ease of manufacture, the carrier rails 23 and hence the matching openings 26 in the plate preferably have circular cross section. Of course, other cross-sectional shapes are possible. Flat rails can be used with narrow carrier plates 2; carrier plates 2 which are extremely wide, and hence heavy, may be supported by more than two rails 23, positioned in suitably spaced locations along the width of the frame 1, that is, across the width of the printing machine.

Various changes and modifications may be made within the scope of the inventive concept.

I claim:

1. In a printing machine, an attachment arrangement for power-positioned doctor blade adjustment apparatus having a frame (1) supporting a plurality of doctor blade control pins (22);

an elongated carrier plate (2) removably facing the frame at one side thereof;

motor means (7) and motion transfer means (6, 8–11) secured to the carrier plate at the side thereof facing the frame, in motion transfer relation to the doctor blade control pins (22);

and means for removably securing the carrier plate, with the motor means and the motion transfer means thereon, from operative connection on the frame while supporting the carrier plate thereon comprising, in accordance with the invention, position sensing means (14–21) secured to the plate at the side remote from said facing side and operatively coupled to the pins (22) to derive a feedback signal of actual pin position;

at least one support rail (23) extending from the frame in a direction beyond the side of the carrier plate (2) remote from said facing side;

suspension means (26) formed on the carrier plate and suspending the carrier plate on the at least one rail;

a releasable end stop (29) releasably limiting suspended translatory movement of the plate on the suspension means;

lateral wings (31) attached to the frame adjacent the narrow lateral sides of the plate and extending to a position matching the position of the plate when translated towards the end stop (29);

and releasable pivot means (32, 33, 36) engageable in the wings and the plate to permit pivoting movement of the plate, and hence the motor and motion transfer means and the position sensing means secured thereto after removal of the plate from operative position adjacent the frame by initial translatory movement along said at least one rail.

2. Arrangement according to claim 1, wherein the releasable pivot means comprises a cross bore (32) formed in the respective wings;

a blind bore (33) formed in the plate in a position matching said cross bore;

and releasable pins (36) inserted in said cross bore and said blind bore.

3. Arrangement according to claim 1, wherein two support rails (23) of circular cross section are provided;

and the suspension means (26) comprises matching openings receiving said rails of circular cross section, with play.

4. Arrangement according to claim 1, further comprising a projection (20) secured to said remote side of the plate and having a length dimensioned to engage the frame (1) after pivoting movement and limiting the pivoting movement by a predetermined angular amount.

5. Arrangement according to claim 4, wherein the limited pivoting movement extends over an angle of between 90° and 180°.

6. Arrangement according to claim 1, wherein the carrier plate (2) extends over the width of the printing machine.

7. Arrangement according to claim 6, wherein at least two support rails are provided, one each located adjacent a lateral side portion of the machine.

8. Arrangement according to claim 1, wherein the motion transfer means comprises a reduction gearing (6) in rotary transfer relation to the motor (7);

a bracket (5) secured to said facing side of the carrier plate and supporting the motor (7) and said reduction gearing (6);

contact blades (8) secured to said bracket and forming electrical terminal contacts for energization of the motor (7);

and wherein the position sensing means comprises a position transducer (19) transducing position signals from said doctor blade adjusting pin to indicating signals.

9. Arrangement according to claim 8, wherein said indicating signals are electrical signals, and said position transducer is a position-electrical signal transducer.

* * * * *